US006431066B1

(12) United States Patent
Perez et al.

(10) Patent No.: US 6,431,066 B1
(45) Date of Patent: Aug. 13, 2002

(54) DOCTOR BLADE

(75) Inventors: Jaime Perez, Bussigny (CH); Philippe Crevoisier, Bulle (FR); Silvano Freti, St. Prex (CH)

(73) Assignee: BTG Eclepens S.A., Eclepens (CH)

( * ) Notice: Subject to any disclaimer, the term of this patent is extended or adjusted under 35 U.S.C. 154(b) by 0 days.

(21) Appl. No.: 09/492,699

(22) Filed: Jan. 27, 2000

(30) Foreign Application Priority Data

Jan. 25, 2000 (SE) ..... 0000215

(51) Int. Cl.[7] ..... B41F 31/00

(52) U.S. Cl. ..... 101/350.6; 101/157; 101/169; 118/261; 118/413

(58) Field of Search ..... 101/154–157, 101/160–162, 164–169, 348–350.1, 350.5, 350.6, 351.7, 352.11; 118/261, 413, 100

(56) References Cited

U.S. PATENT DOCUMENTS

| | | | | | |
|---|---|---|---|---|---|
| 3,703,019 | A | * | 11/1972 | Bratt | 15/256.51 |
| 4,184,629 | A | | 1/1980 | Widmer | |
| 4,841,857 | A | * | 6/1989 | Hashimura et al. | 101/158 |
| 4,960,050 | A | * | 10/1990 | Hatch | 101/348 |
| 5,093,180 | A | * | 3/1992 | Morgan | 428/156 |
| 5,239,925 | A | * | 8/1993 | Bobo | 101/366 |
| 5,728,434 | A | * | 3/1998 | Hewitt | 427/448 |
| 5,735,210 | A | | 4/1998 | Rogge et al. | |
| 5,824,154 | A | * | 10/1998 | Freti | 118/126 |
| 5,863,329 | A | * | 1/1999 | Yamanouchi | 118/100 |
| 6,041,709 | A | * | 3/2000 | Wells et al. | 101/366 |
| 6,207,021 | B1 | * | 3/2001 | Eriksson et al. | 162/281 |

FOREIGN PATENT DOCUMENTS

| | | | |
|---|---|---|---|
| DE | 40 24 514 | | 2/1992 |
| DE | 19508090 | A1 * | 9/1996 |
| EP | 0 350 839 | | 1/1990 |
| GB | 2 128 551 | A | 5/1984 |
| JP | 402204039 | A * | 8/1990 |
| JP | 404193536 | A * | 7/1992 |
| JP | 408260388 | A * | 10/1996 |
| WO | WO 86/07309 | | 12/1986 |

OTHER PUBLICATIONS

US 5,119, 728, 06/1992, Rogge (withdrawn)*

* cited by examiner

*Primary Examiner*—Eugene Eickholt
(74) *Attorney, Agent, or Firm*—Burns, Doane, Swecker & Mathis, LLP

(57) ABSTRACT

A doctor blade for direct contact with a ceramic roll surface. The doctor blade includes a strip of metallic carrier material, which, along one edge section is provided with a ceramic coating. The ceramic coating on the blade has a hardness ranging from approximately 850 to 950 microvickers, thereby substantially increasing wear resistance of the blade without substantially increasing wear on the ceramic roll surface for which the blade is adapted for use.

20 Claims, 1 Drawing Sheet

DOCTOR BLADE

Figure 3A:
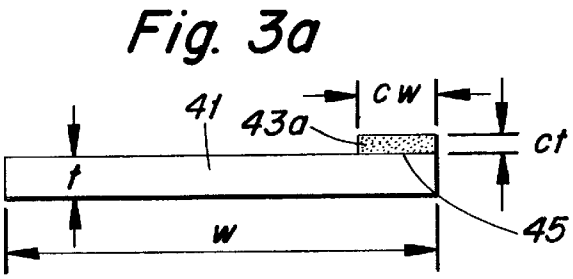

The present invention relates to doctor blades for direct contact with inking rollers provided with ceramic coatings. In particular, the doctor blade is useful for flexographic printing. The invention also provides for a doctor blade unit and a flexographic printer operating with the new doctor blade.

BACKGROUND AND STATE OF THE ART

Although the invention is applicable to all doctor blades for direct contact with inking rollers provided with a ceramic coating the invention will be described mainly with reference to so called flexographic printing.

In the art of flexographic printing the amount of ink is volumetrically metered by the use of a so called anilox roller. This roller is usually constituted by a metal cylinder onto which a ceramic coating has been applied. The ceramic is normally applied by a thermal spray process. For the purpose of volumetric metering of the ink the ceramic surface is laser engraved in order to create uniform cells for carrying and transferring an even ink film onto a printing plate.

For the purpose of removing excess ink from the surface of the anilox or inking roller the state of the art techniques preferably use a so called "chambered doctor blade". U.S. Pat. No. 5,735,210 is an example of prior art making use of such doctor blade concept. The patent describes a doctor blade unit for the inking system of a rotary printing press, said unit comprising a beam carrying two doctor blades in the approximate shape of a roof. These doctor blades define an ink chamber in co-operation with the inking roller, and the entrance blade, also called positive blade, having for a function of sealing the chamber, while the exit blade, also called negative blade, is the one wiping off the excess of ink.

The prior art doctor blades are made of different materials, such as PVC or other fibre-reinforced polymers, but are usually made of steel. Normally, hardened and tempered carbon steel or stainless steel is used, and such steel strip is relatively thin, typically 0.15 mm. Steel blades may have different designs and may either have rounded edges, maybe bevels, so called lamella blades, such as disclosed in for example U.S. Pat. No. 4,184,429. Since the hardness of the blade material is quite low compared to the hardness of the ceramic coating of the ink roller, about 600 micro-Vickers as compared to more than 1200 micro-Vickers, the blade wears off quickly in operation and must therefore be replaced at regular intervals. The quick blade wear causes an uneven wiping over time. Moreover, the productivity of the printing process is significantly reduced by such frequent blade changes.

Furthermore, depending on the type of ink and its content of pigment, abrasive wear of the blade can further decrease the lifetime, such as when using so called white ink containing $TiO_2$ as a pigment which is very abrasive. There are-several reasons for changing the blades in printing operations, such as for example:

- Excess of sliding wear, often related to high pressure load of the blade against the roll.
- Edge wear of the blade on both sides of the chambered doctor blade leading to ink leakage.
- Excess of abrasive wear when hard pigments are used in the printing operation.

In all these cases, as well as in combinations thereof, the sealing and wiping functions cannot be properly fulfilled.

For these and other reasons there is a need for development of doctor blades with improved wear resistance, such as for use in flexographic printing.

OBJECTS OF THE INVENTION

The major object of the present invention is to provide a doctor blade for direct contact with an inking roller-provided with a ceramic coating, shell or sleeve.

Another object of the invention is to provide a doctor blade with extended lifetime thus improving operational productivity.

Yet another object of the invention is to provide a doctor blade with extended lifetime without changing the functionality of the anilox ceramic surface by any premature wear.

Still another object of the invention is to provide a doctor blade unit containing oppositely and toward each other directed doctor blades according to the invention.

A further object of the invention is to provide a flexographic printer including such doctor blade unit.

SUMMARY OF THE INVENTION

It has been found by experimental research that by the application of a ceramic onto a thin steel strip the wear resistance of the blade can be considerably improved without impairing the capacity of the inking roller to transfer the desired amount of ink. Thus, the improved wear resistance of the blade does not result in premature wear of the inking roller. Furthermore, the use of a ceramic coating on the blade eliminates any smearing effect which is typically encountered when steel blades without coating are used. Such smearing is caused by plastic flow of the steel contact surface against the ceramic inking roller. Moreover, the higher abrasive wear resistance of the ceramic as compared to steel greatly improves the lifetime of the blade when abrasive pigments are used.

Finally, the ceramic material which is less sensitive to load differences means that the typical edge wear encountered with steel blades will be significantly postponed. Accordingly, edge leakages are also significantly postponed.

It has been unexpectedly found that the ratio between the hardness of the ceramic coating on the blade and the hardness of the ceramic surface on the inking roller constitutes one of the key elements in the present invention. Thus, it has been found that the hardness ratio, hardness of blade ceramic versus hardness of ceramic roller, shall lie within the range from about 0.55 to about 0.8. Ratios lower than 0.55 do not result in significant advantages as compared to a steel blade which gives a typical ratio of 0.5 or lower. Ratios higher than 0.8 will start increasing wear on the ceramic inking roller. This could result in a decrease of the cell volume and thereby decreasing amount of transferred ink.

Another key aspect of the present invention is the choice of blade coating ceramic. The toughness of the ceramic was found to be another important parameter for the following reasons.

- On a microscopic scale, the abrasive wear resistance of ceramic is directly related to the crack resistance or toughness of the material. Therefore, in order to resist against hard pigments a tough ceramic is to be chosen.
- Furthermore, on a macroscopic scale, the blade must withstand machine vibration, chattering and contact loading at the edge of the ceramic layer without chipping.

Considering these aspects it has been found that materials within the $Al_2O_3$—$ZrO_2$ family, with or without $TiO_2$ addition, fulfill requirements of toughness and adequate hardness when applied by thermal spraying.

Accordingly, the invention provides for a doctor blade for direct contact with an inking roller provided with a ceramic sleeve or shell, said blade comprising a strip of metallic carrier material, wherein said strip, along one edge section thereof facing the inking roller, is provided with a ceramic coating having a wear-resistance lower than that of said sleeve and higher than that of said strip.

Said ceramic coating preferably has a hardness within the range about 55 to about 80% of that of said ceramic sleeve.

It is preferred that the strip forming the blade is constituted by a steel band having a thickness from about 0.05 to about 0.25 mm. The width of the band suitably varies from about 10 to about 60 mm.

The ceramic coating on the blade has preferably a thickness of between about 20 and about 100 $\mu$m, typically about 50 $\mu$m, and a width of from about 1 to about 8 mm, especially from about 4 to about 6 mm, such as about 5 mm.

In regard to the composition of the ceramic blade coating it is preferably based on $Al_2O_3$ and includes $ZrO_2$ in an amount of from about 20 to about 50% by weight. Optionally, the ceramic coating can additionally contain $TiO_2$ in an amount of up to about 20% by weight. These percentages are all based on the total weight of the composition.

According to a preferred embodiment the ceramic coating is provided with a tip bevel having an angle configuration conformed to the surface of the inking roller.

The invention also provides for a doctor blade unit for an inking system of a printing press provided with an inking roller having a ceramic coating or sleeve. This unit comprises a doctor blade holder carrying two doctor blades which are placed oppositely to each other and directed towards each other. These blades are provided with a ceramic coating as described above and are intended for direct contact with the inking roller. One blade is placed in trailing position and the other blade in butting position to the inking roller so as to define an inking chamber together with said inking roller. Trailing and butting positions correspond respectively to positive blade mode and negative blade mode.

Finally, the invention provides for a flexographic printer comprising an inking roller having a ceramic coating or sleeve, an inking system for this inking roller, a printing plate cylinder, and a pressure roller. In operation the printer accommodates a paper web travelling through a nip created between the inking cylinder and the pressure roller. In this flexographic printer the inking system comprises a doctor blade unit as described above, a printing ink container, an ink feeding conduit containing an ink feeding pump for transferring ink from the container to the inking system, and a return conduit for the return of excessive ink to the container.

DESCRIPTION OF SPECIFIC EMBODIMENTS

Figure 2:
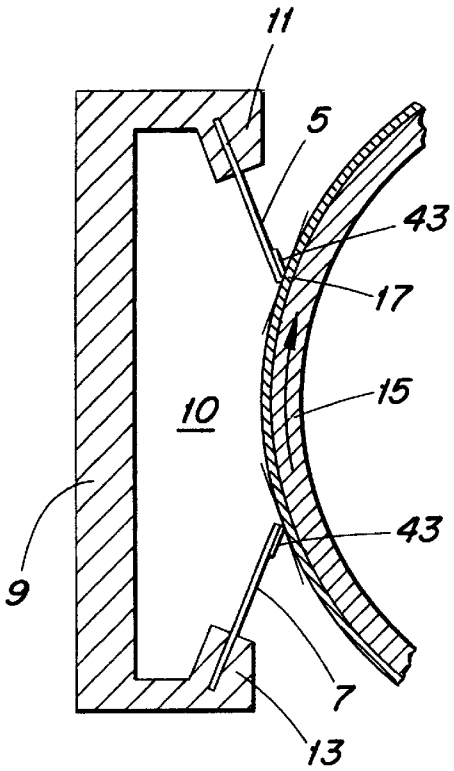
Figure 1:
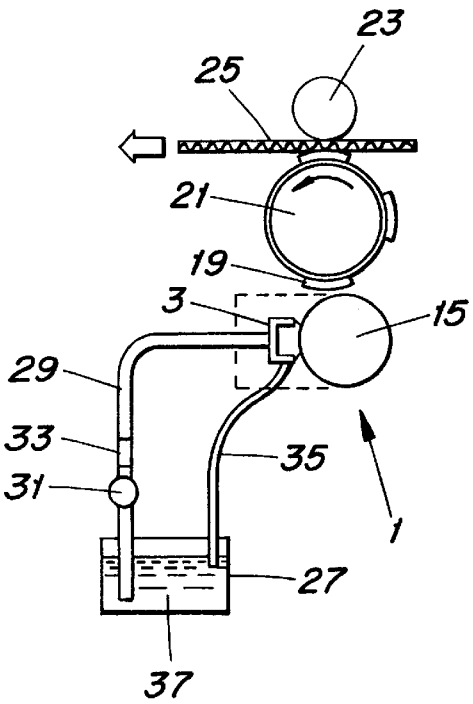

The invention will be described in the following by specific embodiments with reference to the appended drawing. In the drawing:

FIG. 1 shows diagrammatically in a side view a conventional machine for flexographic printing FIG. 2 shows in a side view the arrangement contained within the dashed line square in FIG. 1; and FIGS. 3*a* to 3*d* show diagrammatic side views of four different embodiments of doctor blades.

The flexographic printer 1 shown diagrammatically in FIG. 1 in a side view is provided with an inking blade unit 3 with a blade holder 9 carrying two blades 5,7 to be further described in connection with FIG. 2. Furthermore, the printer 1 has an inking roller 15 constituted by a steel drum covered with a ceramic sleeve or shell. The inking blade unit 3 is associated with a printing ink container 27, an ink feeding conduit 29 containing an ink feeding pump 31 for the transfer of printing ink from an ink supply 37 to the inking blade unit 3. Furthermore, a return conduit 35 is provided for the return of excessive printing ink to the container 27.

Finally, the printer 1 is provided with a printing plate cylinder 21 carrying printing plates 19, and a pressure roller 23. A paper web 25 for printing travels in the nip between rollers 21,23 in the direction indicated in FIG. 1.

In FIG. 2 there is shown by an enlarged side view the arrangement around the inking blade unit 3 as contained within the dashed line square of FIG. 1. The blade holder 9 is provided with two carrier flanges 11,13, each carrying a blade 5,7 travelling in butting and trailing positions, respectively, vis-à-vis the inking roller 15. The inking roller 15 is comprised of a steel cylinder 15 covered by a ceramic shell or sleeve 17.

As is seen from FIG. 2 blade 7 has a sealing function, whereas blade 5 has a wiping function removing excess printing ink from the surface of the ceramic sleeve 17. The inking blade unit 3 defines an inking chamber 10 together with the inking roller 15 with blades 5,7 in engagement on the surface of the inking roller 15. Blades 5,7 are each provided with a ceramic coating 41 facing the surface of the inking roller 15.

FIGS. 3*a* to 3*d* show four different embodiments of the doctor blade according to the invention.

Figure 3B:
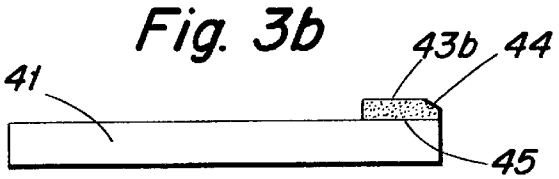

FIG. 3*a* shows in a side view a steel strip 41 having an edge section 45 coated with a ceramic coating 43*a*. FIG. 3*b* shows a similar arrangement but with the ceramic coating 43*b* being provided with a bevel 44 adapted to the conformation of the surface of the inking roller 15.

Figure 3C:
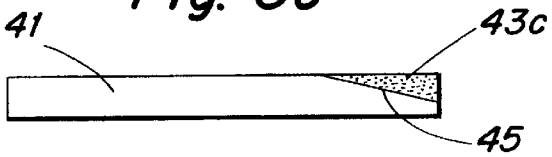

FIG. 3*c* shows an embodiment with the steel strip 41 being provided with a bevel 45 on the edge section, the ceramic coating 43*c* having a corresponding triangular configuration.

Figure 3D:
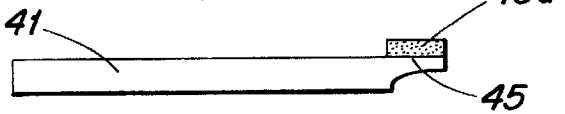

Finally, FIG. 3*d* shows an embodiment of the lamella type, wherein the strip edge section has a recess opposite to the ceramic coating 43*d*.

The invention will now ba further illustrated by examples disclosing experimental procedures and data using the inventive concept. The inking rollers used are of the type anilox rolls which are commercially available. Anilox rolls are mainly based on a ceramic material constituted by thermally sprayed and laser engraved $Cr_2O_3$. The hardness figures of these ceramic material according to micro-Vickers is ranging from about 1200 to about 1400. It should, however, be noted that the present invention is in no respect restricted to the conditions and materials disclosed in the examples, but the invention is restricted only as reflected by the scope of the appended claims.

EXAMPLES

Example 1

Abrasive Wear Resistance of Doctor Blades

This experiment was conducted in order to compare different brands of existing doctor blades with one selected ceramic material corresponding to the presently described findings.

A heavy wear trial was selected using the following parameters:

| Flexo test unit | Chambered doctor blade, Masterflex 160A ® (Bobst) no printing was done |
|---|---|
| Anilox roll | Ø 216 mm, 80 lines/cm Ucarlox ® (Praxair) |
| Ink | White $TiO_2$, 22–24 seconds viscosity (Sicpa) |
| Speed | 160 m/min |
| Load | 2,2–2.4 bars |
| Duration | 7 hrs |

These conditions ware kept constant in all trials. For each test, the same blades wore chosen for both blade positions. The amount of wear was measured by width reduction of the blade. The table below presents the results.

| Material | Blade thickness (mm) | Width reduction (mm) Negative blade | Positive blade |
|---|---|---|---|
| Steel Brand A | 0.150 | 3.8 | 0.8 |
| Steel Brand B (lamella type) | 0.150 | 4.0 | 1.2 |
| MDC ® longlife* | 0.190 | 2.7 | 0.0 |
| Composite (Fiberflex ®) | 0.500 | 6.0 | 4.0 |
| Ceramic tipped, Type I | 0.150 (+0.050) | 0.2 | 0.0 |

*Dätwyler; Ni base electroless plating

The ceramic tipped blade, type I, consists of a 50 $\mu$m layer on top of a 0.150 mm thick steel doctor blade (see FIG. 41*a*). The material used is an APS thermally sprayed $Al_2O_3$—$ZrO_2$ ceramic in the weight proportion of 60% $Al_2O_3$—40% $ZrO_2$.

The micro-Vickers hardness is about 850 HV0.3 and the hardness ratio compared with the ceramic roll is 0.6 to 0.7.

The width of the ceramic layer was 8 mm.

In can be seen from these results that the amount of blade wear was considerably reduced by the blade according to the invention.

Example 2

Anilox Wear Survey

In another experiment the same ceramic blade type I as used in Example 1 above was run on an experimental flexo test system for survey of the anilox wear, by measuring the cell volume before and after the test. The conditions were as follows:

| Flexo test unit | Chambered doctor blade (Tresu) |
|---|---|
| Anilox roll | 120 lines/cm, 8 $cm^3/m^2$ Ucarlox ® (Praxair) |
| Ink | 85% of time aqueous<br>15% of time dry |
| Speed | 370 m/min |
| Duration | 100 hrs |

The cell measurement performed by the URMI technique gave the following results:

Before: 7.4±1 $cm^3/m^2$

After: 7.6±1 $cm^3/m^2$

Example 3

Real Printing Survey

In a third experiment another composition of the blade material (ceramic type II), according to the invention was used on a regular basis in a web flexo machine during several months (3 shift printing unit). Here both wear of blade and survey of the anilox roll were evaluated. The conditions were:

| Flexo test unit | Chambered doctor blade (Fischer & Krecke) blade in the negative position |
|---|---|
| Anilox roll | New 260 l/m, Ø 187 mm, transfer values 4.0–4.3 $cm^3/m^2$ Ucarlox ® (Praxair) (supplier data) |
| Ink | Cyan |
| Speed range | 260–330 m/min |

| Anilox survey | | |
|---|---|---|
| Time | URMI | Cell depth ($\mu$m) |
| Start | 3.8 $cm^3/m^2$ | 13 |
| 4 months later | 3.5 $cm^3/m^2$ | 11–12 |

During this period, 14 mio meters have been printed. The URMI results as well as the cell depth show some slight decrease, which can be explained by the fact that the anilox was new at the beginning and therefore may present some initial higher wear until the bridge between the cells are better defined. It can also be concluded that the ceramic tipped blade here were at the upper hardness ratio acceptable and some wear really occurs on the anilox roll.

In this case, the selected ceramic tipped blade (type II) was as follows:

| | |
|---|---|
| Steel thickness | 0.150 mm |
| Ceramic thickness | 50 $\mu$m, according to FIG. 3a |
| Ceramic width | 5 mm |
| Ceramic type | $Al_2O_3/ZrO_2$ (80% $Al_2O_3$, 20% $ZrO_2$)<br>APS sprayed<br>Hardness 950 HV0.3 |
| Hardness ratio with ceramic roll | 0.7 – 0.8 |

The lifetime of the blade according to the invention reached 16 days non-stop as record and about 8 days in average.

Detailed Description of the Blade

A typical chambered doctor blade situation is shown in FIG. 1.

Preferential embodiments of the blade tip are shown in FIGS. 3*a–d*. The steel thickness (t) may vary between 0.05 to 0.25 mm. The steel width (w) is ranging from 10 to 60 mm. The ceramic layer thickness (ct) after grinding is 50 $\mu$m typically, in a range from 20 to 100 $\mu$m.

The width of the ceramic (cw) is preferably 5 mm, but may range from 1 mm to 8 mm.

Ceramic tip can be unbevelled or bevelled. The unbevelled offers the advantage to be adaptable to any chambered doctor blade configuration, It requires a very tough ceramic edge.

The composition of the ceramic is $Al_2O_3$ base, with $ZrO_2$ amount varying from 20 to 50%, preferably 40%.

Additions of $TiO_2$ (0 to 20%) can further improve the sliding properties, if necessary.

What is claimed is:

1. A doctor blade for use on a thermally sprayed and subsequently laser engraved ceramic roll surface, said doctor blade comprising:

a strip of metallic carrier material, one edge section of said strip being provided with a ceramic coating, said ceramic coating having a hardness ranging from approximately 850 to 950 microvickers, thereby substantially increasing wear resistance of said blade without substantially increasing wear on the ceramic roll surface on which said blade is adapted for use.

2. A doctor blade according to claim 1, wherein said ceramic coating has a hardness within the range from about 0.55 to about 0.80 of that of the ceramic roll surface on which said blade is adapted for use.

3. A doctor blade according to claim 1, wherein said strip is constituted by a steel band having a thickness within the range from about 0.05 to about 0.25 mm.

4. A doctor blade according to claim 1, wherein said ceramic coating has a thickness within the range from about 20 to about 100 $\mu$m and a width of from about 1 to about 8 mm.

5. A doctor blade according to claim 1, wherein said ceramic coating is based on $Al_2O_3$ and includes $ZrO_2$ in an amount of from about 20 to about 50% by weight, based on the total weight of the composition.

6. A doctor blade according to claim 1, wherein said ceramic coating is provided with a tip bevel for conforming to the surface of the ceramic roll surface.

7. A doctor blade according to claim 2, wherein said strip is constituted by a steel band having a thickness within the range from about 0.05 to about 0.25 mm.

8. A doctor blade according to claim 2, wherein said ceramic coating has a thickness within the range from about 20 to about 100 $\mu$m and a width of from about 1 to about 8 mm.

9. A doctor blade according to claim 3, wherein said ceramic coating has a thickness within the range from about 20 to about 100 $\mu$m and a width of from about 1 to about 8 mm.

10. A doctor blade according to claim 7, wherein said ceramic coating has a thickness within the range from about 20 to about 100 $\mu$m and a width of from about 1 to about 8 mm.

11. A doctor blade according to claim 2, wherein said ceramic coating is based on $Al_2O_3$ and includes $ZrO_2$ in an amount of from about 20 to about 50% by weight, based on the total weight of the composition.

12. A doctor blade according to claim 3, wherein said ceramic coating is based on $Al_2O_3$ and includes $ZrO_2$ in an amount of from about 20 to about 50% by weight, based on the total weight of the composition.

13. A doctor blade according to claim 4, wherein said ceramic coating is based on $Al_2O_3$ and includes $ZrO_2$ in an amount of from about 20 to about 50% by weight, based on the total weight of the composition.

14. A doctor blade according to claim 7, wherein said ceramic coating is based on $Al_2O_3$ and includes $ZrO_2$ in an amount of from about 20 to about 50% by weight, based on the total weight of the composition.

15. A doctor blade according to claim 8, wherein said ceramic coating is based on $Al_2O_3$ and includes $ZrO_2$ in an amount of from about 20 to about 50% by weight, based on the total weight of the composition.

16. The doctor blade according to claim 2, wherein said ceramic coating is provided with a tip bevel adapted to conform to the surface of the ceramic roll surface.

17. The doctor blade according to claim 3, wherein said ceramic coating is provided with a tip bevel adapted to conform to the surface of the ceramic roll surface.

18. The doctor blade according to claim 4, wherein said ceramic coating is provided with a tip bevel adapted to conform to the surface of the ceramic roll surface.

19. A doctor blade according to claim 5, wherein said ceramic coating further includes $TiO_2$ in an amount of up to about 20% by weight, based on the total weight of the composition.

20. A doctor blade unit for use with a thermally sprayed and subsequently laser engraved ceramic roll surface, said unit comprising:

a doctor blade holder carrying two oppositely and toward each other directed doctor blades, each said doctor blade including a strip of metallic carrier material, one edge section of said strip being provided with a ceramic coating, said ceramic coating having a hardness ranging from approximately 850 to 950 microvickers, thereby substantially increasing wear resistance of said blade without substantially increasing wear on the ceramic roll surface on which said blade is adapted for use;

wherein one said blade is adapted for a trailing position and the other said blade is adapted for a butting position with the ceramic roll surface, for thereby defining an inking chamber together therewith.

* * * * *